US009362663B2

(12) United States Patent
Maroney et al.

(10) Patent No.: US 9,362,663 B2
(45) Date of Patent: Jun. 7, 2016

(54) REPLACEABLE BUSHING FOR ELECTRICAL EQUIPMENT

(71) Applicant: S&C Electric Company, Chicago, IL (US)

(72) Inventors: Michael R. Maroney, Chicago, IL (US); Hector Roman, Kenosha, WI (US)

(73) Assignee: S&C ELECTRIC COMPANY, Chicago, IL (US)

( * ) Notice: Subject to any disclaimer, the term of this patent is extended or adjusted under 35 U.S.C. 154(b) by 0 days.

(21) Appl. No.: 14/680,117

(22) Filed: Apr. 7, 2015

(65) Prior Publication Data

US 2015/0288093 A1 Oct. 8, 2015

Related U.S. Application Data

(60) Provisional application No. 61/976,315, filed on Apr. 7, 2014, provisional application No. 62/128,173, filed on Mar. 4, 2015.

(51) Int. Cl.
*H01R 13/53* (2006.01)
*H01R 13/658* (2011.01)

(52) U.S. Cl.
CPC ..... *H01R 13/53* (2013.01); *H01R 13/658* (2013.01)

(58) Field of Classification Search
CPC ..... H01R 13/53; H01R 13/6485
See application file for complete search history.

(56) References Cited

U.S. PATENT DOCUMENTS

| | | | | |
|---|---|---|---|---|
| 3,740,700 | A * | 6/1973 | Robertson | H01F 27/04 174/73.1 |
| 4,354,721 | A * | 10/1982 | Luzzi | H01R 13/53 439/306 |
| 4,591,216 | A | 5/1986 | McClune | |
| 4,722,694 | A * | 2/1988 | Makal | H01R 13/53 439/181 |
| 4,857,021 | A | 8/1989 | Boliver et al. | |
| 4,955,823 | A * | 9/1990 | Luzzi | H01R 13/53 439/507 |
| 6,744,255 | B1 | 6/2004 | Steinbrecher et al. | |
| 7,870,668 | B2 * | 1/2011 | Hughes | H01R 13/53 29/857 |
| 2003/0027452 | A1 | 2/2003 | Jazowski | |
| 2011/0256746 | A1 | 10/2011 | Borgstrom et al. | |

FOREIGN PATENT DOCUMENTS

EP 0624924 B1 9/2002

OTHER PUBLICATIONS

United States International Searching Authority, International Search Report and Written Opinion for International Application No. PCT/US15/24689 mailed Jul. 13, 2015.

* cited by examiner

*Primary Examiner* — Gary Paumen
(74) *Attorney, Agent, or Firm* — Ingrassia Fisher & Lorenz, PC

(57) ABSTRACT

An electrical equipment connector having a replaceable bushing for an electrical power connector is disclosed. The replaceable bushing includes an insulator body having a tapered exterior surface formed on the first end, and a tapered interior surface formed in a second end. A conductor body extends through the insulator body and has a through bore with a counterbore at one end. A captured bolt in the counterbore engages a threaded tap in a conductor body disposed in the housing such that the tapered interior surface fits over and conforms to a tapered exterior surface on the housing connector.

24 Claims, 5 Drawing Sheets

REPLACEABLE BUSHING FOR ELECTRICAL EQUIPMENT

CROSS-REFERENCE TO RELATED APPLICATIONS

This application claims the benefit of U.S. Provisional Application No. 61/976,315 filed on Apr. 7, 2014 and U.S. Provisional Application No. 62/128,173 filed on Mar. 4, 2015. The entire disclosure of each of the above applications is incorporated herein by reference.

TECHNICAL FIELD

The present disclosure relates generally to power distribution systems, and more particularly relates to a replaceable bushing to transition between a connection interface on electrical equipment, such as switchgear, and a power cable through a separable connector.

BACKGROUND

This section provides background information related to the present disclosure that is not necessarily prior art.

Electrical equipment such as electrical switchgear used in electric power distribution systems requires connection of power cables for electric power distribution. In certain applications, such as underground and pad-mounted applications, a power cable will be terminated with a separable connector that is coupled to a switchgear terminal interface or connector. Electrical switchgear may be provided with a proprietary or non-standard interface that requires a bushing for transitioning from the proprietary or non-standard interface on the electrical equipment to an industry-standard interface on the separable connector. Industry-standard interfaces are dictated by standards organizations such as IEEE, ANSI, IEC, and Cenelec. These standards provide specifications for manufacturers of separable connectors that define dimensions, test requirements and ratings for the electrical power interconnect.

In order to provide an effective interconnection between a separable connector on a power cable and electrical equipment, the separable connector requires proper preparation of the power cable, for example, stripping various layers of the cable to different lengths, installation of the separable connector onto the prepared power cable ends, and attachment of the separable connector with power cable onto the switchgear bushing interface. The process of preparing cable ends, installing the separable connectors onto the cable ends, and attaching the separable connector with power cable onto the switchgear requires a certain level of skill. Faulty materials or workmanship during any part of the process may result in a dielectric breakdown in the area of the separable connector to switchgear interface, resulting from errors in cable preparation, faulty power cables, faulty separable connectors, separable connectors not properly sized for the power cable, improper assembly of the separable connector onto the power cable, improper assembly of the separable connector onto the switchgear interface, or contamination of any electrical interface. A dielectric breakdown in the area of the separable connector may cause irreparable damage to the connector on the switchgear that requires significant repair and/or replacement of the switchgear assembly.

Accordingly, it is desirable to provide an easy and effective interconnection of the power cable/connector assembly to the electrical equipment that also can be replaced in a simple manner without major repair or replacement of the electrical equipment. In addition, it is desirable to provide an adaptor for a power cable/connector having an industry-standard interface with electrical equipment having a proprietary or non-standard interface. Furthermore, other desirable features and characteristics of the present disclosure will become apparent from the subsequent detailed description and the appended claims, taken in conjunction with the accompanying drawings and this background of the invention.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

An electrical equipment connector having a replaceable bushing for an electrical power connector is disclosed. The housing for electrical equipment has a connector with a first tapered or conical exterior surface extending from the housing. A conductor body extends through the connector. The conductor body has a tap in an end located at the end of the exterior tapered surface. The replaceable bushing includes an insulator body having a tapered or conical exterior surface formed on the first end and a tapered or conical interior surface formed in a second end. While the embodiment described and illustrated herein includes an insulator body configured with tapered exterior surface on the power cable side and a tapered interior surface on electrical equipment side, one skilled in the art will recognize that each end of the insulator body may be configured with either a tapered interior surface or a tapered exterior surface in accordance with the particular application, requirements and standards of the power distribution system. A through bore extends from the first end to the tapered interior surface and receives a conductor body. A through bore extends from the first end to the second end of the bushing conductor body. A counter bore is formed in the second end of the bushing conductor body.

A bolt is partially received in the counter bore. A retainer ring, disposed in the counter bore at the second end of the conductor, captures a head of the bolt in the counter bore. A portion of the threaded body extends through the retainer ring and is received in the tap to threadably engage the conductor body in the housing connector. A conductive cover extends over the insulator body from a base of the tapered exterior surface to the second end of the insulator body. A drive recess formed in the bolt head is accessible from the first end of the bushing conductor body via the through bore for attaching and detaching the replaceable bushing with the housing connector. In one embodiment, the exterior tapered surface on the bushing has an industry-standard taper and the exterior tapered surface on the housing connector has a non-industry-standard or proprietary taper, such that the replaceable bushing functions as an adapter between these differing tapers.

Example embodiments will now be described more fully with reference to the accompanying drawings. There is no intention to be limited by any principle presented in the preceding background or the following detailed description.

Figure 1:
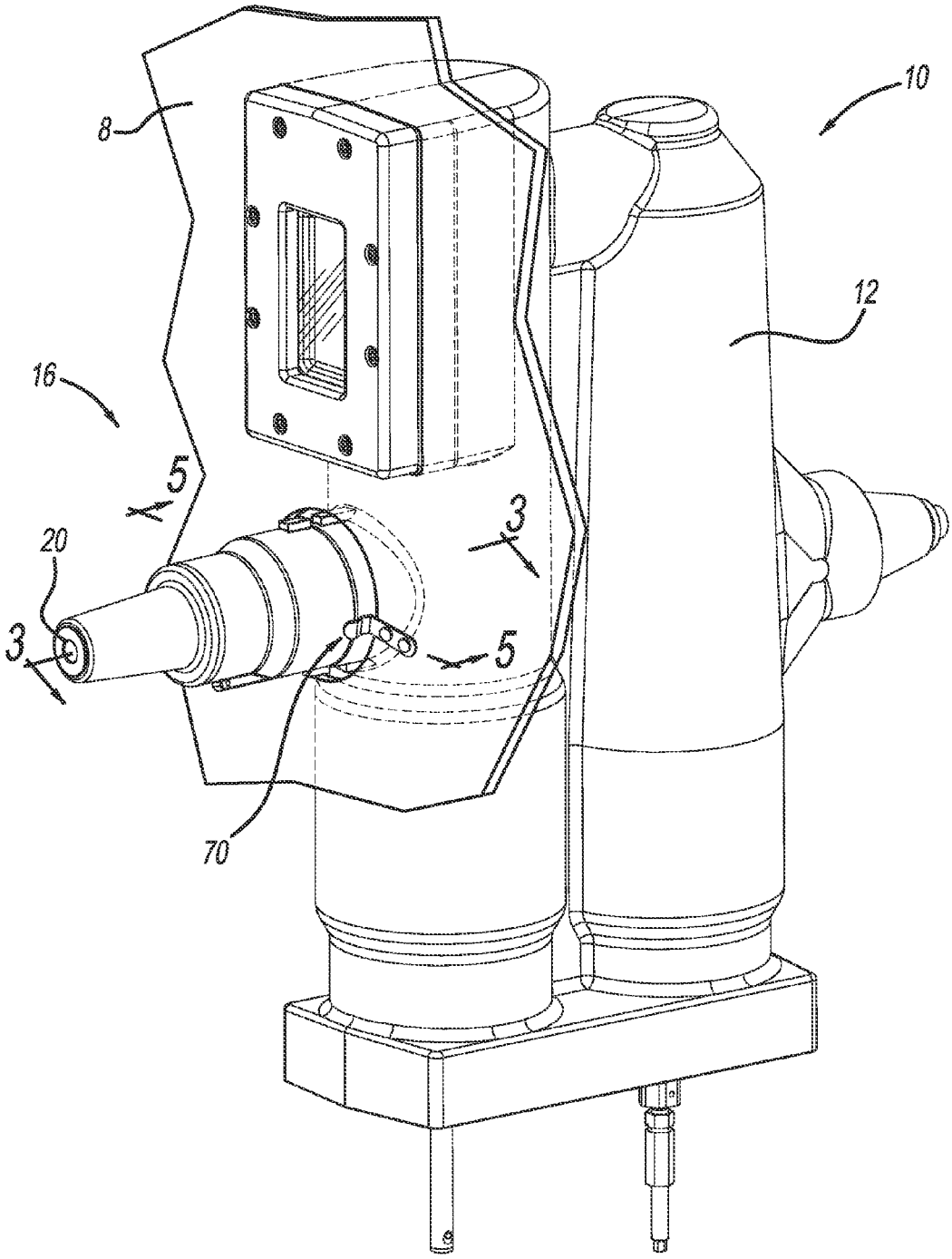
FIG. 1 is a perspective view of an electrical equipment assembly in the form of switchgear pole unit with a field replaceable bushing.
Figure 2:
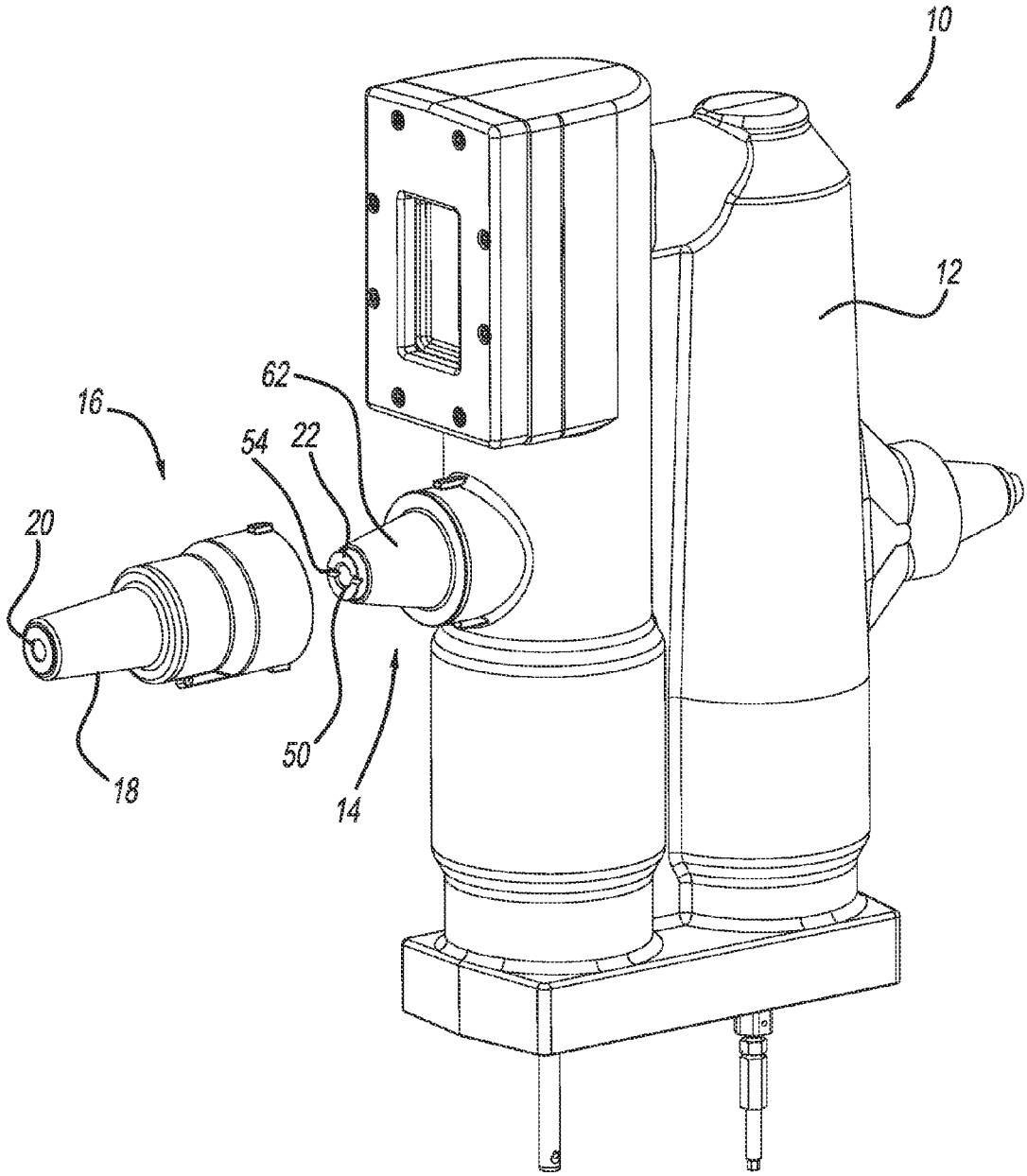
FIG. 2 is an expanded perspective view of the electrical equipment assembly shown in FIG. 1.

With reference now to FIGS. 1-2, electrical equipment 10 in the form of a switchgear or a circuit-interrupting device is illustrated. The electrical equipment 10 includes a housing 12 molded from an electrically-insulating material with an electrically conductive covering. The housing includes a connector 14 (FIG. 2) and a replaceable bushing 16 releasably coupled to the housing 12 via the connector 14. While the electrical equipment 10 illustrated in FIGS. 1-2 is a pole unit for switchgear used in various power distribution systems, the replaceable bushing could be used with other electrical equipment found in power distribution systems, as well as other electrical connection applications in which electrical power is conducted from a power cable through a housing to the components of an electrical equipment.

In a preferred embodiment, the replaceable bushing 16 has a tapered or conical exterior surface 18 formed thereon. A conductor body 20 terminates at the end of the tapered exterior surface 18. A separable connector (not shown) may be releasably secured to the replaceable bushing 16 for electrically coupling a power cable to the electrical equipment 10 in a manner well known in the art. The replaceable bushing 16 is releasably secured to the connector 14 of housing 12. The conductor body 20 is electrically coupled with a conductor body 22 extending through the connector 14. In this way, electrical continuity is provided from conductor body 20 through conductor body 22 into the components of electrical equipment enclosed within housing 12.

Figure 3:
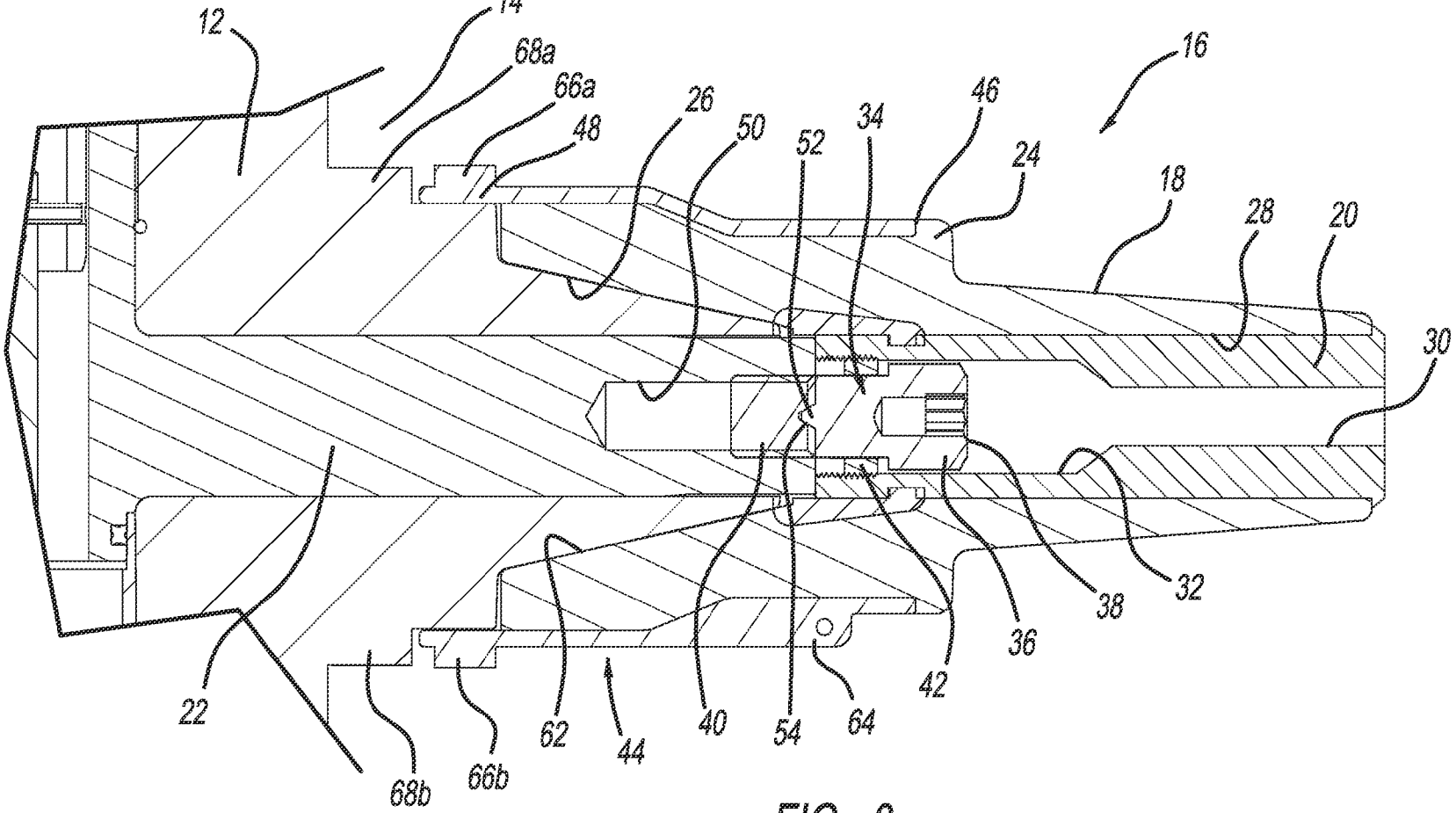
FIG. 3 is a cross-section take along line 3-3 in FIG. 1 showing the housing connector and replaceable bushing.
Figure 4:
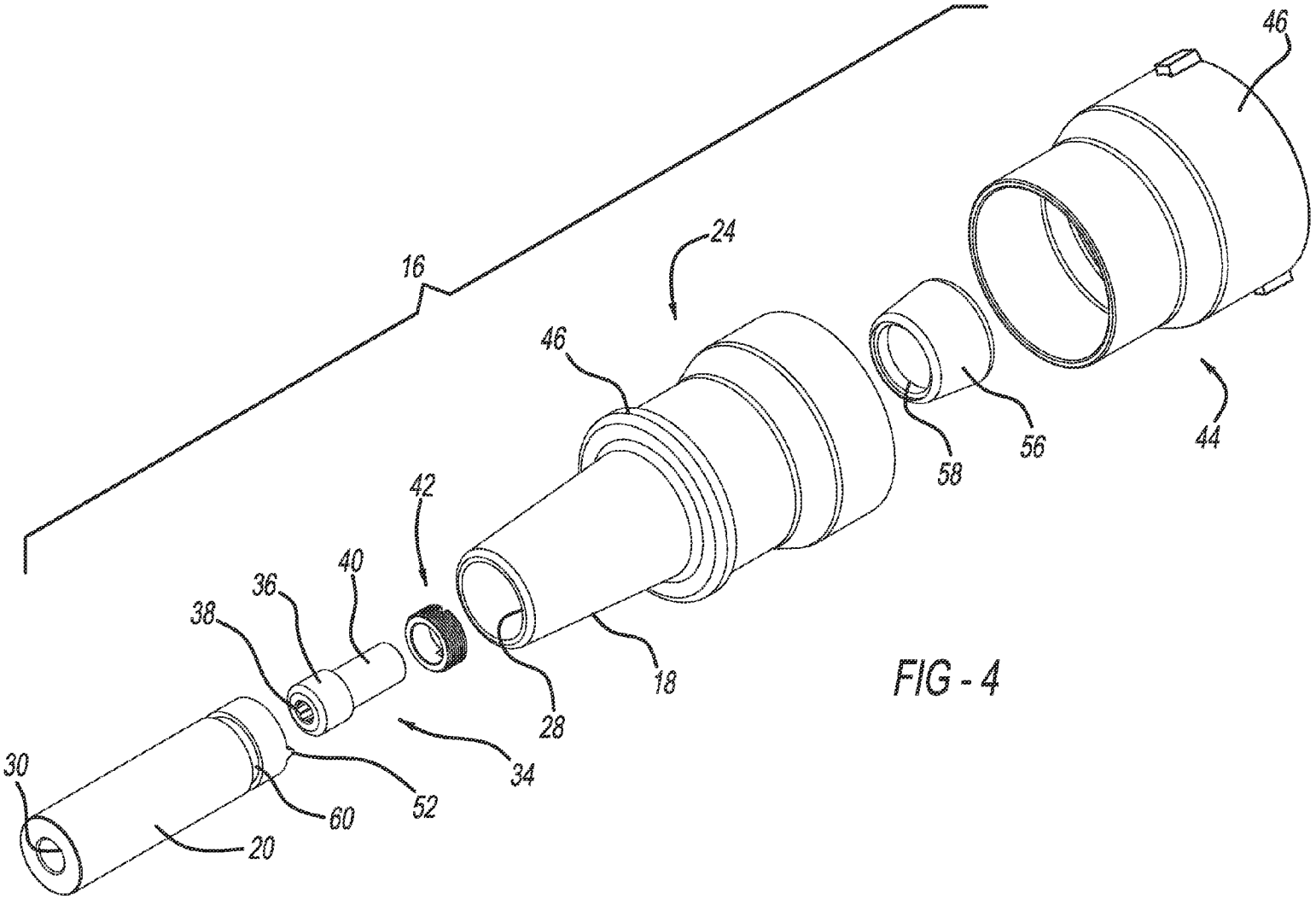
FIG. 4 is an expanded perspective view of the replaceable bushing components.

With reference now to FIGS. 3-4, the replaceable bushing 16 includes an insulator body 24 on which the tapered or conical exterior surface 18 is formed on a first end. A tapered or conical interior surface 26 is formed in a second end of the insulator body 24. A through bore 28 extends from the first end of the insulator body 24 to the tapered interior surface 26, and receives the conductor body 20. The conductor body 20 has a through bore 30 extending from the first end to the second end, and a counter bore 32 extending from the second end of the conductor 20.

A bolt 34 is partially disposed in the counter bore 32. The bolt 34 has a head 36 with a drive recess 38 formed therein. The bolt 34 has a threaded body 40 extending from head 36. A retainer ring 42 is threadably secured in the counter bore 32. The retainer ring 42 captures the head 36 of bolt 34 in the counter bore 32. A portion of the threaded body 40 extends through the retainer ring 42 and into the tapered interior surface 26 of insulator body 24. A conductive covering 44 extends over the insulator body 24 from a base of the tapered exterior surface 46 to the second end of the insulator body 24. An end 48 of the conductive cover 44 may extend beyond the second end of the insulator body 24 to sealably engage and provide a continuous conductive covering with the connector 14 as best seen in FIG. 3. The conductive covering 44 has a tab 64 with a hole formed therethrough such that a conductive lead in the form of a wire (not shown) may be used to conductively couple the replaceable bushing 16 to other electrical equipment in the power distribution system.

Figure 5:
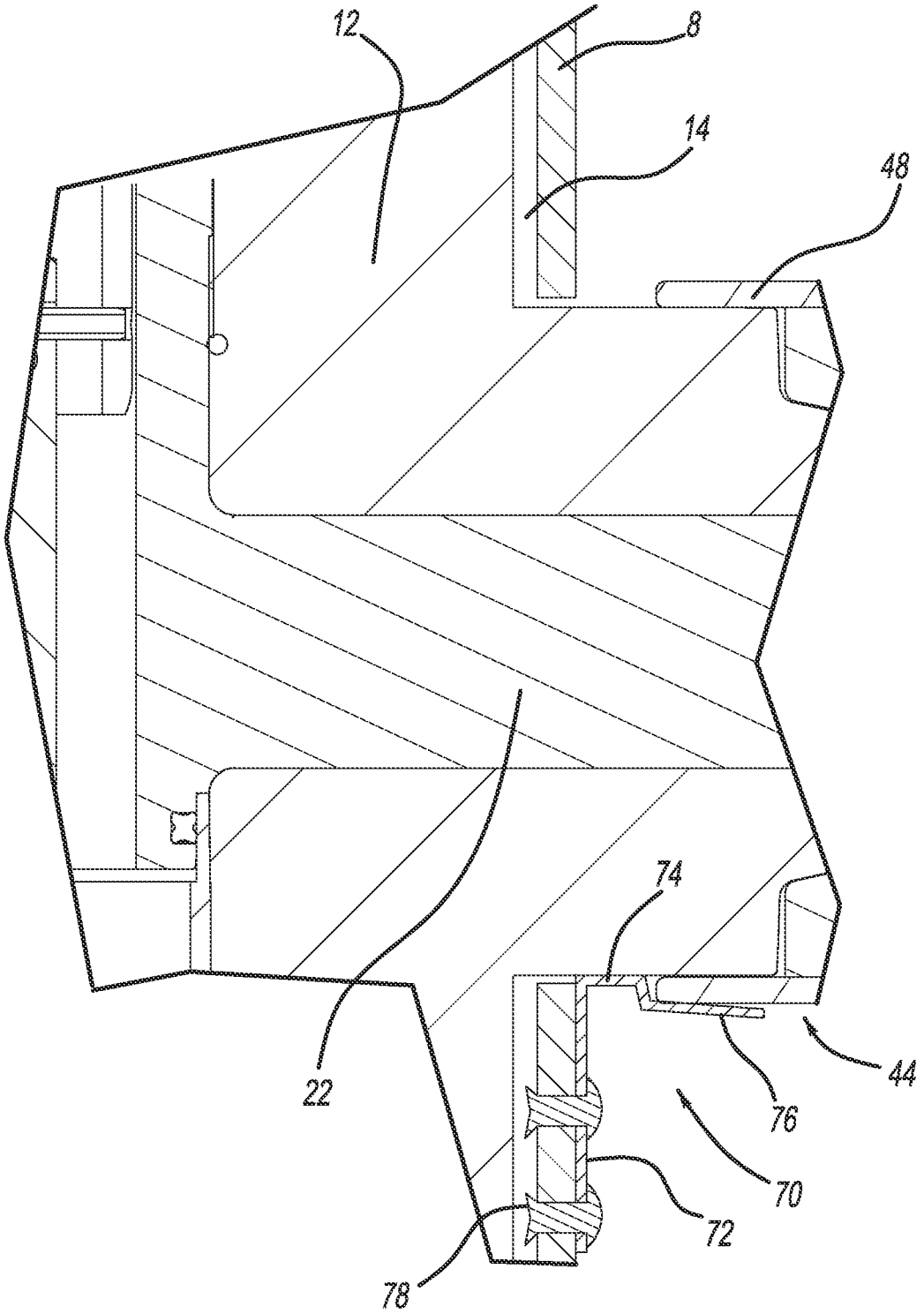
FIG. 5 is a cross-section take along line 5-5 in FIG. 1 showing the details of the grounding clip.

Alternately or additionally, a self-gauging shield drain dip 70 may be used to make an electrical connection when the bushing 16 is installed on the electrical equipment 10. In this way, continuity between a metal shield 8 (shown in FIGS. 1 and 5 as stainless steel housing), housing 12 and conductive covering 44 is automatically established. As best seen in FIG. 5, drain clip 70 has a tab portion 72 secured to the metal shield 8 with rivets 78 or other suitable means for providing conductive coupling therebetween. A self-gauging portion 74 is formed in the middle of the drain clip 70 and is positioned in contact with the connector portion 14 of housing 12. The self-gauging portion 74 provides an automatic locating feature so that the conductive covering 44 is coupled to ground each and every time the bushing 16 is installed. The drain clip 70 terminates at a clip portion 76 extending away from shield 8. The clip portion 76 is spaced away from connector portion 14 to receive the end 48 of conductive covering 44 when the hushing 16 is inserted onto the housing 12. Using either a conductive lead through the conductive covering 44 or a shield drain clip 70 between the conductive covering 44, housing 12 and shield 8 ensures that the conductive covering 44 of the bushing 16 is at ground potential.

The conductive covering 44 also includes a pair of alignment features 66*a*, 66*b* visible on the exterior surface thereof As illustrated in FIG. 3, the alignment feature includes a raised indicator molded into the conductive covering 44. Likewise, the housing 12 has a pair of alignment features 68*a*, 68*b* which are visible on the exterior surface thereof. As illustrated in FIG. 3, the alignment feature 68*a*, 68*b* includes a raised indicator molded into the housing 12 which cooperate with alignment features 66*a*, 66*b* to indicate the orientation between the connector 14 and the replaceable bushing 16 for proper installation. While alignment features 66, 68 are described and illustrated as being raised indicators, one skilled in the art will recognized that engraved features, contrasting colors or other visual indicators and combinations thereof may be utilized as alignment features 66, 68 to indicate proper orientation and alignment of the replaceable bushing 16.

As noted above, the head of bolt 34 is captured in the counter bore 32. A portion of the threaded body 40 extends through the retaining ring 42 and into a threaded blind bore or tap 50 formed in the end of conductor body 22. As presently preferred, the retaining ring 42 is incredibly received in the counter bore 32. The threading of the retainer ring 42 is in a direction opposite the threading of the threaded body 40 of bolt 34 to prevent loosening of the retainer ring 42 during tightening of the bolt 34. For example, the retaining ring 42 is provided with a left-hand thread, while the bolt 34 is provided with a conventional right-hand thread. The second end of the conductive body 20 has an engagement feature formed thereon. As best seen in FIGS. 3-4, the engagement feature on the conductive body 20 is a ridge 52 extending from an end face thereof. Similarly, end of conductive body 22 has an engagement feature formed thereon. The engagement feature on the conductive body 22 is a slot 54 formed in an end face thereof. The ridge 52 and slot 54 mate to prevent relative rotation between conductor bodies 20, 22 during tightening and loosening operations of separable connectors applied to the replaceable bushing 16. Use of the alignment features 66, 68 when installing the replaceable bushing 16 onto the connector 12 aids with proper engagement of the ridge 52 into the slot 54.

The replaceable bushing 16 further includes a semi-conductive shield 56 disposed on the second end of the conductor body 20. As best seen in FIG. 3, the semi-conductive shield 56 extends partially into the tapered interior surface 26 of the insulator body 24 and functions to electrically shield the interface between conductor bodies 20, 22. The interference fit between exterior tapered surface 62 and interior tapered interface 26 functions to seal the interface between conductor bodies 20, 22 and to provide an interface of sufficient quality to prevent electrical activity between and along this interface.

The semi-conductive shield 56 as a bead 58 formed around an upper edge thereof. The bead 58 is received within a circumferential groove 60 formed in the conductor body 20 adjacent the second end for securing and retaining the shield 56 onto the conductor body 20. As presently preferred, the wall thickness of the conductor body 20 at the retainer ring 42 is equal to the wall thickness of the conductor body 20 and the circumferential groove 58. Similarly, the circumferential groove 58 is longitudinally spaced from the retainer ring 42 by a distance at least equal to the wall thickness of the conductor body 20 at the retainer ring 42. In this way, the current path through the second end of the bushing conductor body 20 is dimensionally consistent.

As presently preferred, the exterior tapered surface 18 formed on the bushing 16 is an industry-standard interface such as the industry-standards dictated by organizations including IEEE, ANSI, IEC, or Cenelec. The connector 14, likewise, has an exterior tapered or conical surface 62 formed thereon. As presently preferred, the exterior tapered surface 62 formed on the connector 14 is a proprietary or non-industry-standard interface. The exterior tapered surface 62 conforms to the tapered interior surface 26 of the bushing 16. In this manner, bushing 16 provides an adapter fur a power cable/connector having an industry-standard interface with electrical equipment having a proprietary or non-industry-standard interface. Furthermore, the replaceable bushing 16 provides a means for easily and effectively interconnecting a power cable/connector assembly (not shown) to the electrical equipment 110 which can be replaced in a simple manner without major repair or replacement of the electrical equipment 10.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the disclosure, and all such modifications are intended to be included within the scope of the disclosure.

What is claimed is:

1. A replaceable bushing for an electrical power connector comprising:

an insulator body having a first tapered surface formed on the first end, a second tapered surface formed in a second end;

a conductor body disposed within the insulator body and having a through bore extending from a first end to a second end and a counterbore in the second end;

a bolt having a head with a drive recess formed therein and a threaded body, the bolt being at least partially received in the counter bore;

a retainer ring disposed in the counterbore at the second end of the conductor, wherein the head is captured in the counterbore and at least a portion of the threaded body can extend through the retainer ring; and a conductive cover extending over at least a portion of the insulator body;

wherein the drive recess of the bolt head is accessible from the first end of the conductor body via the through bore.

2. The replaceable bushing of claim 1 further comprising a semi-conductive shield disposed on the second end of the conductor body and surrounding the portion of the threaded body extending through the retainer ring.

3. The replaceable bushing of claim 2 wherein the semi-conductive shield has a circumferential bead formed thereon which fits into a circumferential groove formed in the conductor body adjacent the second end.

4. The replacement bushing of claim 3 wherein a first wall thickness of the conductor body at the retainer ring is equal to a second wall thickness of the conductor body at the circumferential groove.

5. The replacement bushing of claim 4 wherein the circumferential groove is longitudinally spaced from the retainer ring by a distance at least equal to the first wall thickness.

6. The replaceable bushing of claim 1 wherein the retainer ring is threadably received in the counterbore.

7. The replaceable bushing of claim 6 wherein threading of the retainer ring is in a direction opposite the threading of the threaded body to prevent loosening of the retainer ring during tightening of the bolt.

8. The replaceable bushing of claim 1 wherein the second end of the conductor body has an engagement feature formed therein.

9. The replaceable bushing of claim 8 wherein the engagement feature comprises a ridge extending from an end face of the second end.

10. The replaceable bushing of claim 1 wherein the first tapered surface defines a tapered exterior surface and the second tapered surface defines a tapered interior surface.

11. The replaceable bushing of claim 1 wherein the first tapered surface defines an industry-standard tapered interface, and the second tapered surface defines a non-industry-standard tapered interface.

12. An electrical equipment connector for coupling to a separable power cable connector having an industry-standard tapered interface, the connector comprising:

a housing for electrical equipment having a connector with a first tapered surface formed thereon;

a first conductor body extending through the connector and terminating at a connector end, the first conductor body having a tap in the connector end;

a replaceable bushing releasably coupled to the housing and electrically coupled to the first conductor body, the replaceable bushing including:

an insulator body having a second tapered surface formed on the first end, a third tapered surface formed in a second end which conforms to the first tapered surface of the connector;

a second conductor body disposed in the insulator body and having a through bore extending from a first end to a second end and a counterbore in the second end;

a bolt having a head with a drive recess formed therein and a threaded body, the bolt being partially received in the counter bore;

a retainer ring disposed in the counterbore at the second end of the second conductor body, wherein the head is captured in the counterbore and a portion of the threaded body extends through the retainer ring and into the tap in the first conductor body to electrically couple the first and second conductor bodies; and a conductive cover extending over at least a portion of the insulator body and providing electrical continuity with the connector;

wherein the drive recess of the bolt head is accessible from the first end of the conductor body via the through bore for threadably coupling and uncoupling the replaceable bushing with the housing.

13. The electrical equipment connector of claim 12 wherein the replaceable bushing further comprising a semi-conductive shield disposed on the second of the conductor body and surrounding the portion of the threaded body extending through the retainer ring.

14. The electrical equipment connector of claim 13 wherein the semi-conductive shield has a circumferential bead formed thereon which fits into a circumferential groove formed in the conductor body adjacent the second end.

15. The electrical equipment connector of claim 14 wherein a first wall thickness of the conductor body at the retainer ring is equal to a second wall thickness of the conductor body at the circumferential groove.

16. The electrical equipment connector of claim 15 wherein the circumferential groove is longitudinally spaced from the retainer ring by a distance at least equal to the first wall thickness.

17. The electrical equipment connector of claim 12 wherein the retainer ring is threadably received in the counterbore.

18. The electrical equipment connector of claim 17 wherein threading of the retainer ring is in a direction opposite the threading of the threaded body to prevent loosening of the retainer ring during tightening of the bolt.

19. The electrical equipment connector of claim 12 wherein the connector end of the first conductor body has a first engagement feature formed therein, and the second end of the second conductor body has a second engagement feature formed therein, the first and second engagement feature mating to prevent relative rotation between the first and second conductor bodies.

20. The electrical equipment connector of claim 19 wherein the first engagement feature comprises a slot formed in the connector end and the second engagement feature comprises a ridge extending from an end face of the second end and into the slot.

21. The electrical equipment connector of claim 19 wherein the connector has a first alignment feature formed thereon, and the replaceable bushing has a second alignment feature formed thereon, the first and second alignment features cooperating to indicate proper alignment of the first and second engagement features.

22. The electrical equipment connector of claim 12 wherein the first tapered surface defines a tapered exterior surface, the second tapered surface defines a tapered exterior surface and the third tapered surface defines a tapered interior surface.

23. The electrical equipment connector of claim 12 wherein the first tapered surface defines a non-industry-standard tapered interface and the second tapered surface defines an industry-standard tapered interface.

24. The electrical equipment connector of claim 12 further comprising a drain clip having a tab portion secured to an equipment shield, a self-gauging portion in contact with the housing and a clip portion extending from the self-gauging portion and engaging the conductive covering, wherein continuity is establish between the equipment shield, the self-gauging portion and the conductive covering.

* * * * *